US011874002B2

(12) United States Patent
Deng et al.

(10) Patent No.: US 11,874,002 B2
(45) Date of Patent: Jan. 16, 2024

(54) INTEGRAL AIR CONDITIONER

(71) Applicant: GD MIDEA AIR-CONDITIONING EQUIPMENT CO., LTD., Guangdong (CN)

(72) Inventors: Jingwen Deng, Guangdong (CN); Jingqiang Jiang, Guangdong (CN); Gang Liu, Guangdong (CN)

(73) Assignee: GD MIDEA AIR-CONDITIONING EQUIPMENT CO., LTD., Guangdong (CN)

( * ) Notice: Subject to any disclaimer, the term of this patent is extended or adjusted under 35 U.S.C. 154(b) by 0 days.

(21) Appl. No.: 17/736,555

(22) Filed: May 4, 2022

(65) Prior Publication Data

US 2022/0260260 A1 Aug. 18, 2022

Related U.S. Application Data

(63) Continuation of application No. PCT/CN2020/086379, filed on Apr. 23, 2020.

(30) Foreign Application Priority Data

Nov. 29, 2019 (CN) ..... 201922133137.5

(51) Int. Cl.
*F24F 1/029* (2019.01)
*F24F 11/89* (2018.01)

(52) U.S. Cl.
CPC ..... *F24F 1/029* (2019.02); *F24F 11/89* (2018.01)

(58) Field of Classification Search
CPC ..... F24F 11/89; F24F 1/029; F24F 1/0284
See application file for complete search history.

(56) References Cited

U.S. PATENT DOCUMENTS

2007/0171620 A1* 7/2007 Lee ..... H01R 13/447 361/737
2019/0212018 A1* 7/2019 Kim ..... F24F 13/222

FOREIGN PATENT DOCUMENTS

CN 1699848 A 11/2005
CN 102207310 A 10/2011
CN 108571782 A 9/2018
(Continued)

OTHER PUBLICATIONS

International Search Report dated Aug. 26, 2020 issued in PCT/CN2020/086379.
Written Opinion dated Aug. 26, 2020 issued in PCT/CN2020/086379.

*Primary Examiner* — Schyler S Sanks
(74) *Attorney, Agent, or Firm* — Scully, Scott, Murphy & Presser, P.C.

(57) ABSTRACT

An integral air conditioner is provided. An electric control box of the air conditioner is split into at least a first box body and a second box body. The first box body is arranged between a first fan shell and a middle partition plate. The second box body is arranged below the middle partition plate. A first fan has a first fan wheel and the first fan shell. Since the first fan wheel rotates around a shaft, the first fan shell generally has an arc-shaped edge. A gap is presented between a surface of the first fan shell and the middle partition plate. The electric control box is split into multiple box bodies and constructed to match the shape of the first fan shell. The first box body of the multiple box bodies is arranged in the gap between the first fan shell and the middle partition plate.

12 Claims, 9 Drawing Sheets

(56) References Cited

FOREIGN PATENT DOCUMENTS

| | | | |
|---|---|---|---|
| CN | 110062566 | A | 7/2019 |
| EP | 0534805 | A2 | 3/1993 |
| KR | 20190084589 | A | 7/2019 |
| KR | 20190119969 | A | 10/2019 |
| KR | 20190129374 | A | 11/2019 |

* cited by examiner

INTEGRAL AIR CONDITIONER

CROSS-REFERENCE TO RELATED APPLICATIONS

The present application is a continuation application of PCT International Patent Application No. PCT/CN2020/086379, filed on Apr. 23, 2020, which claims priority to and benefits of Chinese Application No. 201922133137.5, filed on Nov. 29, 2019 and entitled "INTEGRAL AIR CONDITIONER", the entire contents of which are incorporated herein by reference for all purposes. No new matter has been introduced.

FIELD

The present disclosure relates to the field of air conditioners, and more particularly, to an integral or portable air conditioner.

BACKGROUND

A structure of an existing integral air conditioner is designed to be relatively compact, and an electric control box of the integral air conditioner is of an integral structure. With the increasing functions of the integral air conditioner and the increasingly complex electric control, such as adding a frequency conversion function, it is necessary to accommodate corresponding functional modules in the electric control box, which increases the volume of the electric control box and enlarges the structure of the electric control box bigger. With the increased volume of the electric control box, as the electric control box is being mounted inside the integral air conditioner, the internal structure of the integral air conditioner is significantly affected.

SUMMARY

The present disclosure aims to solve at least one of the technical problems in related arts to some extent. Therefore, the present disclosure provides an integral or portable air conditioner, where an electric control box with a large volume can be mounted inside the integral air conditioner in a split manner, and the influence of the electric control box with complex functional modules on the internal structure of the integrated air conditioner is reduced.

In a first aspect, an embodiment of the present disclosure provides an integral air conditioner, including:

a middle partition plate, where an upper air duct assembly is arranged above the middle partition plate, the upper air duct assembly includes a first fan wheel and a first fan shell, and the first fan wheel is arranged in the first fan shell and used for driving an air flow in the first fan shell to flow; and an electric control box, including a first box body and a second box body, where the second box body is arranged below the middle partition plate, and the first box body is arranged above the middle partition plate and located below the first fan shell.

The integral air conditioner according to this embodiment of the present disclosure at least has the following beneficial effects: the electric control box is of a split structure, and the electric control box is split into at least two box bodies. The electric control box is split into the first box body and the second box body, the first box body is arranged between the first fan shell and the middle partition plate, and the second box body is arranged below the middle partition plate. A first fan includes the first fan wheel and the first fan shell.

Because the first fan wheel rotates around a shaft, the first fan shell generally has an arc-shaped edge, which causes the presence of a large gap between a surface of the first fan shell arranged above the middle partition plate facing the middle partition plate and the middle partition plate. In this embodiment, the electric control box is split into multiple box bodies and constructed to match the shape of the first fan shell, and the first box body in the multiple box bodies is arranged in the gap between the first fan shell and the middle partition plate, so that scattered spaces inside the integral air conditioner are fully utilized, and the influence of the electric control box with complex functional modules on the internal structure of the integral air conditioner is reduced.

In an exemplary embodiment of the present disclosure, an evaporator is arranged above the middle partition plate, and the first fan wheel drives the air flow in the first fan shell to pass through the evaporator.

For example, the first fan wheel is a cross-flow fan wheel.

In an exemplary embodiment of the present disclosure, the integral air conditioner further includes a lower air duct assembly arranged below the middle partition plate.

In an exemplary embodiment of the present disclosure, a condenser is arranged below the middle partition plate, the lower air duct assembly includes a centrifugal fan wheel, and the centrifugal fan wheel is used for driving the air flow to pass through the condenser.

In an exemplary embodiment of the present disclosure, the integral air conditioner further includes a first bracket arranged on an upper surface of the middle partition plate. The first box body is arranged on the first bracket.

In an exemplary embodiment of the present disclosure, the first box body includes:

a circuit board arranged on the first bracket; and a first cover body, where the first cover body is connected to the first bracket and covered on a periphery of the circuit board.

In an exemplary embodiment of the present disclosure, the first cover body includes a first front cover and a first rear cover, and the first front cover is detachably connected with the first rear cover.

In an exemplary embodiment of the present disclosure, the first front cover is detachably connected with the first rear cover by a buckle structure.

In an exemplary embodiment of the present disclosure, the integral air conditioner further includes a second bracket arranged on a lower surface of the middle partition plate. The second box body is arranged on the second bracket.

Additional aspects and advantages of the present disclosure will be explained in part in the following description, which can become apparent from the following description or be understood through practice of the present disclosure.

BRIEF DESCRIPTION OF DRAWINGS

The above and/or additional aspects and advantages of the present disclosure can become apparent and easy to understand from the description of embodiments in conjunction with the following drawings, where.

REFERENCE NUMERALS

Figure 1:
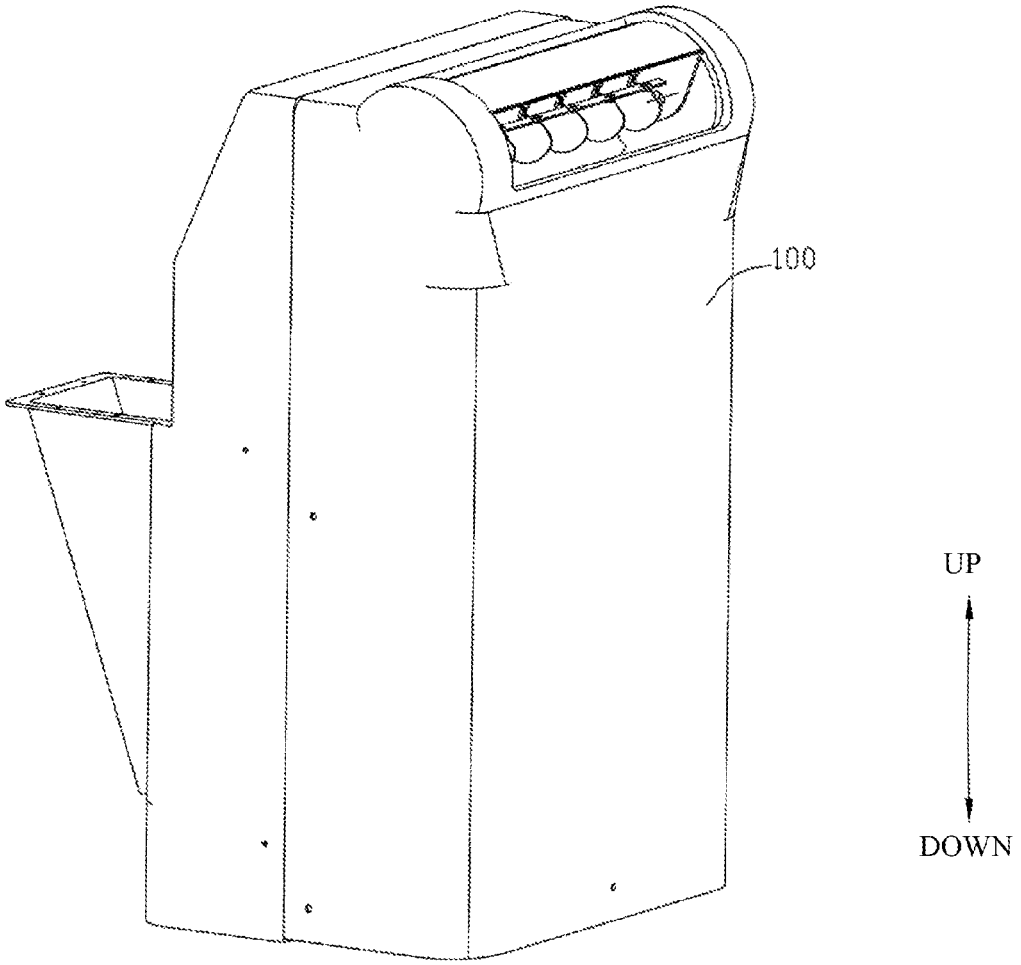
FIG. 1 is a schematic structural diagram of an integral air conditioner in its entirety according to an embodiment of the present disclosure.

100 refers to outer shell;

200 refers to middle partition plate, 210 refers to upper cavity, and 220 refers to lower cavity;

300 refers to upper air duct assembly, and 310 refers to first fan shell;

400 refers to lower air duct assembly, and 410 refers to second fan shell;

510 refers to condenser, and 520 refers to evaporator;

600 refers to first box body, 610 refers to first bracket, 620 refers to first rear cover, 621 refers to female buckle, 630 refers to first front cover, 631 refers to male buckle, 640 refers to protective cover, 650 refers to circuit board, and 660 refers to heat dissipation fin; and

700 refers to second box body.

DETAILED DESCRIPTION OF EMBODIMENTS

Embodiments of the present disclosure are described below in detail, illustrations of which are shown in the accompanying drawings, where identical or similar reference numerals denote identical or similar elements or elements having the same or similar functions. The embodiments described below by reference to the accompanying drawings are intended only to explain the present disclosure and are not to be construed as limiting the present disclosure.

In the description of the present disclosure, it should be understood that any orientation/position related description, such as the orientational or positional relationship, such as, up, down, front, rear, and the like, is based on the orientational or positional relationship shown in the accompanying drawings, is only for the purpose of facilitating the description of the present disclosure and simplifying the description, and does not indicate or imply that the device or element must have a specific orientation or position, be constructed and operated in a specific orientation or position, and therefore shall not be understood as a limitation to the present disclosure.

In the description of the present disclosure, words such as first and second in the description are used for distinguishing the technical features only, and cannot be understood as indicating or implying relative importance, implicitly indicating the number of technical features indicated thereby, or implicitly indicating the order of technical features indicated thereby.

In the description of the present disclosure, words such as setup, installation, and connection shall be understood in a broad sense unless otherwise expressly limited, and a person skilled in the art may reasonably determine the specific meaning of the above words in the present disclosure with reference to the context of the technical scheme.

In related art, an electric control box of an integrated air conditioner is basically of an integral structure, with increasing functions and increasingly complex electric control, so that the volume of the electric control box becomes larger, and if the electric control box is placed in a same space in the integral air conditioner, there will be a great influence and limitation on the interior structure and size of the integral air conditioner.

On this basis, the present disclosure provides an integral air conditioner, in which an electric control box is split into multiple box bodies, and idle spaces caused by some components with particular structures in the integral air conditioner are used to mount the multiple box bodies. For example, a fan generally includes a shell with a circular cross section and a fan wheel arranged in the shell, and rotation of the fan wheel drives an air flow in the shell to flow. When the fan is mounted above a middle partition plate 200 of the integral air conditioner, due to a curved surface of the shell, the idle spaces may exist between an edge of the shell and the middle partition plate 200. Generally, the idle spaces each have a small volume, and cannot be used for assembling large-scale components, such as an evaporator 520 and a condenser 510, which results in ineffective utilization of an internal space of the integral air conditioner.

By splitting the electric control box of a large volume into multiple box bodies, and fully utilizing the idle spaces inside the integral air conditioner, the influence of the electric control box with complex functional modules and a large volume on the internal structure of the integrated air conditioner is reduced.

Many different implementations or examples are provided below for implementing different structures of the present disclosure.

Figure 2:
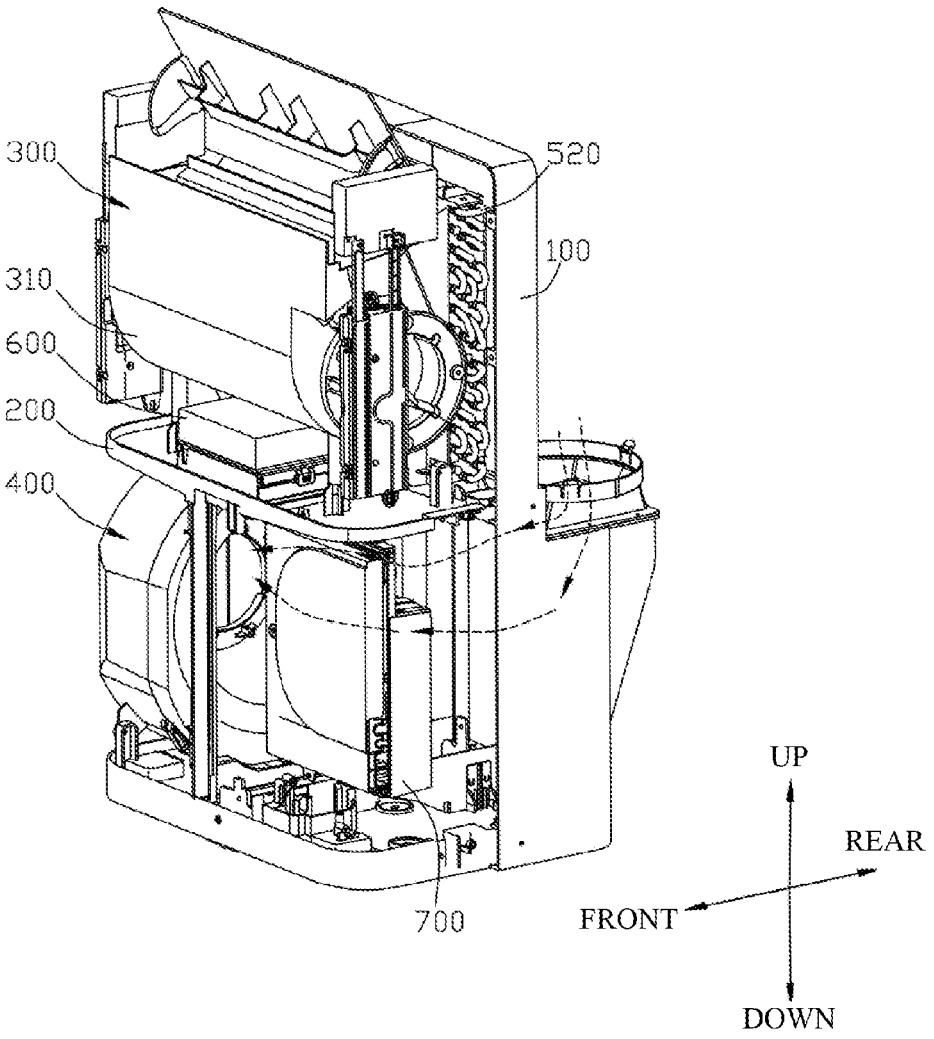
FIG. 2 is a schematic structural diagram of a part of an integral air conditioner according to an embodiment of the present disclosure.
Figure 3:
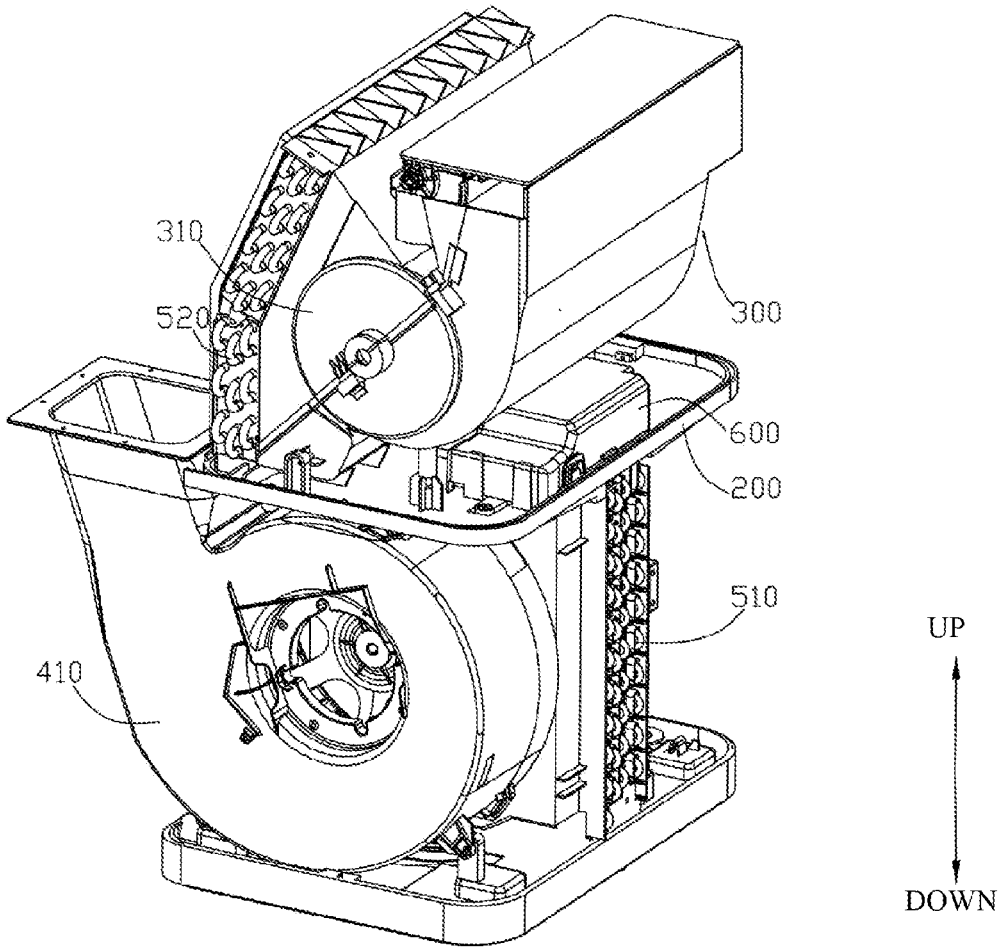
FIG. 3 is a schematic structural diagram of a heat dissipation structure from one perspective according to an embodiment of the present disclosure.

The dotted lines with an arrow in FIG. 2 indicate a flow direction of an air flow.

Figure 7:
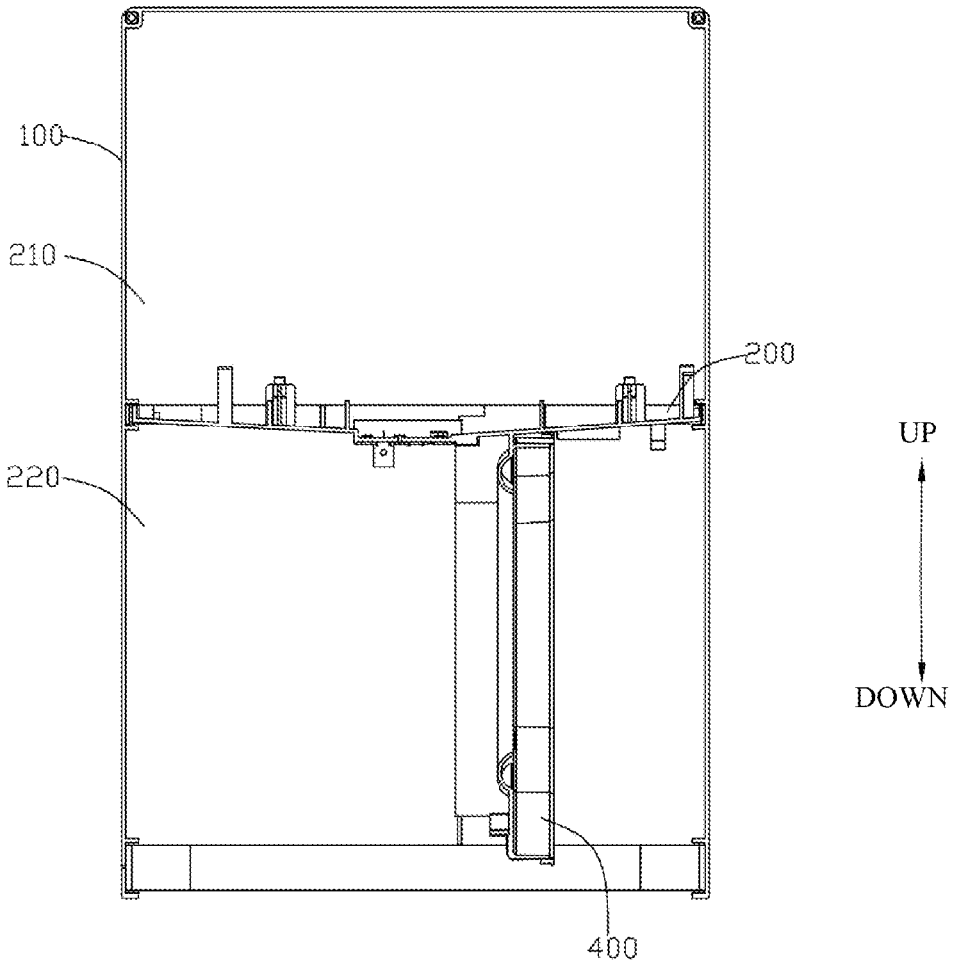
FIG. 7 is a cross-sectional view of an integral air conditioner according to an embodiment of the present disclosure.

With reference to FIG. 1, FIG. 2 and FIG. 7, a first embodiment of the present disclosure provides an integral air conditioner. The integral air conditioner includes a middle partition plate 200 and an electric control box. An upper air duct assembly 300 is arranged above the middle partition plate. The upper air duct assembly 300 includes a first fan wheel and a first fan shell 310, and the first fan wheel is arranged in the first fan shell 310 and used for driving an air flow in the first fan shell 310 to flow. The electric control box includes a first box body 600 and a second box body 700. The second box body 700 is arranged below the middle partition plate 200, and the first box body 600 is arranged above the middle partition plate 200 and located below the first fan shell 310.

In this embodiment, the electric control box is split into multiple box bodies, including but being not limited to two box bodies. For convenience of explanation, the electric control box is split into two box bodies in this embodiment, including the first box body 600 and the second box body 700.

The integral air conditioner includes an outer shell 100, the middle partition plate 200 is arranged in the outer shell 100, and an internal space of the outer shell 100 is divided into an upper cavity 210 located above the middle partition plate 200 and a lower cavity 220 located below the middle partition plate 200. The upper air duct assembly 300 is arranged in the upper cavity 210. The upper air duct assembly 300 includes a first fan, and the first fan includes the first fan wheel and the first fan shell 310. The first fan wheel is arranged in the first fan, and is used for driving an air flow in the first fan to flow. A cross section of the first fan shell 310 along a direction perpendicular to a rotation shaft of the first fan wheel is circular, so that the first fan shell 310 has a curved surface. Therefore, idle spaces may be generated between an edge of the first fan shell 310 and the middle partition plate 200, and no components are mounted in the idle spaces during assembly of the integral air conditioner. In this embodiment, the idle spaces between the first fan shell 310 and the middle partition plate 200 are fully utilized with the electric control box of a large volume being split into multiple box bodies and the multiple box bodies being mounted in these idle spaces. As a result, the space inside the integral air conditioner can be more effectively utilized, and at the same time, the volume and the structure of the integral air conditioner at can be simplified.

In this embodiment, the first box body 600 is arranged above the middle partition plate 200, the second box body 700 used as another part of the electric control box is arranged below the middle partition plate 200, and the electric control box of a large volume is split into smaller volumes, for example, the first box body 600 and the second box body 700. Thus, the scattered spaces inside the integral air conditioner can be reasonably utilized. Thus, the electric control box with more functional modules can be mounted in the integral air conditioner without affecting the internal structure of the integral air conditioner.

Figure 4:
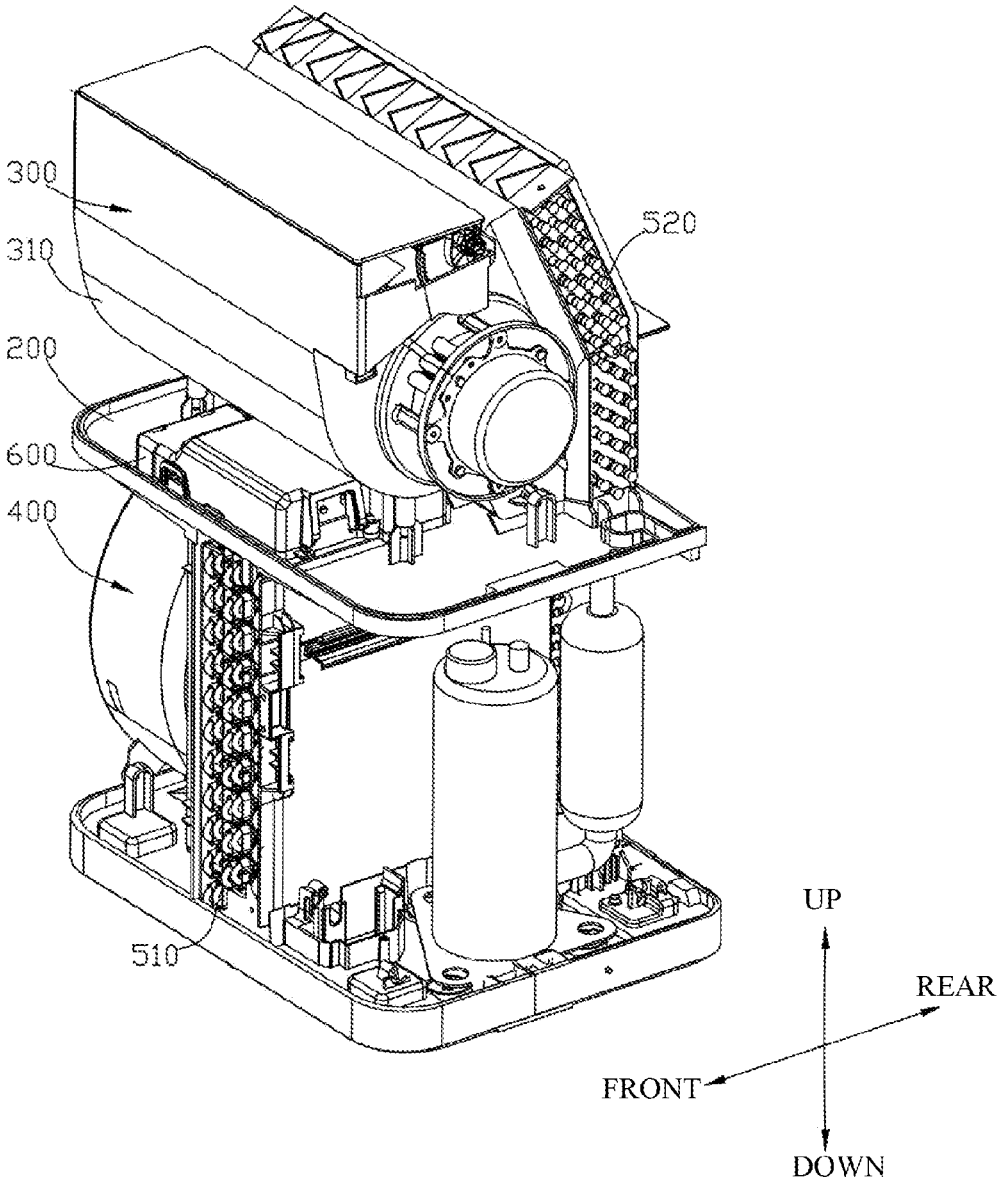
FIG. 4 is a schematic structural diagram of a heat dissipation structure from another perspective according to an embodiment of the present disclosure.
Figure 5:
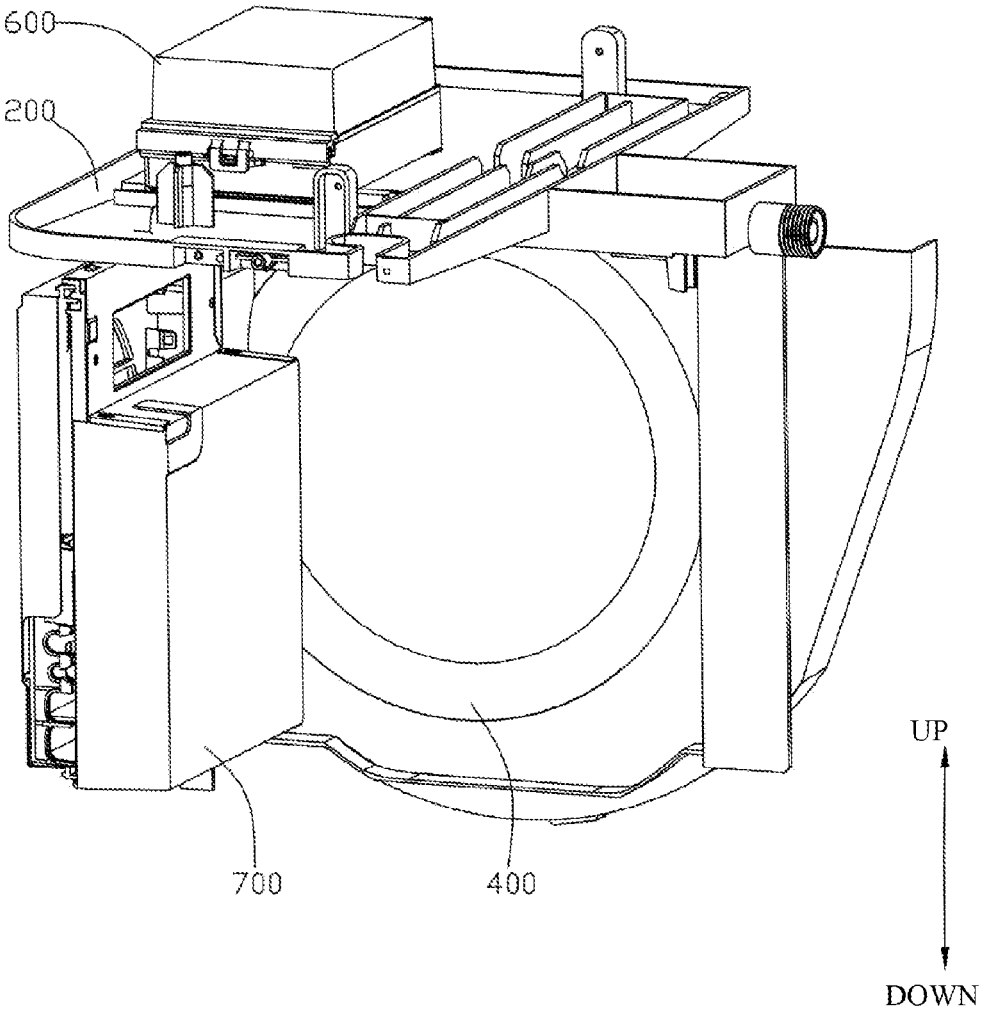
FIG. 5 is a schematic structural diagram of a part of a heat dissipation structure according to an embodiment of the present disclosure.

As shown in FIG. 4 and FIG. 5, a second embodiment of the present disclosure provides an integral air conditioner. In this embodiment, an evaporator 520 is arranged above a middle partition plate 200, and a first fan wheel drives an air flow in a first fan shell 310 to pass through the evaporator 520.

In this embodiment, the evaporator 520 is arranged above the middle partition plate 200, and an upper air duct assembly 300 uses the evaporator 520 to exchange heat for the air flow in the first fan shell 310, thus reducing a temperature around the first fan shell 310, and achieving an effect of cooling a first box body 600.

In one implementation, the upper air duct assembly 300 is a first fan. The first fan includes the first fan wheel and the first fan shell 310. The first fan wheel is arranged in the first fan shell 310, and drives the air flow in the first fan shell 310 to flow. A first air inlet of the first fan faces the evaporator 520. When the first fan wheel rotates, a lower-temperature air flow at the first air inlet of the first fan flows into the first fan shell 310 under the driving of the first fan wheel after heat exchange by the evaporator 520. Finally, cold air is blown to a first air outlet of the first fan. When the lower-temperature air flow passes through an inside surface of the first fan shell 310, heat from the air flow on an outside surface of the first fan shell 310 may be rapidly transferred to the first fan shell 310, thus improving a heat dissipation effect of the first box body 600 located between the first fan shell 310 and the middle partition plate 200.

In another embodiment, an upper air duct assembly 300 includes a first fan and a shell body. The first fan includes a first fan wheel and a first fan shell 310. The first fan wheel is arranged in the first fan shell 310, and drives an air flow in the first fan shell 310 to flow. The shell body is enclosed between a first air inlet of the first fan and an evaporator 520 to form an air inlet channel. When the first fan wheel rotates, an air flow in the atmosphere becomes a lower-temperature air flow after heat exchange by the evaporator 520 and enters one end of the air inlet channel. Driven by the first fan wheel, the air flow in the air inlet channel flows into the first fan shell 310 from the other end of the air inlet channel, and finally, cold air is blown to a first air outlet of the first fan. When the lower-temperature air flow passes through an inside surface of the first fan shell 310, heat from the air flow on an outside surface of the first fan shell 310 may be rapidly transferred to the first fan shell 310, thus improving a heat dissipation effect of a first box body 600 located between the first fan shell 310 and a middle partition plate 200. Meanwhile, because a first shell body is provided to restrict communication between the first air inlet of the first fan and the air inlet channel, it is ensured that the air flow entering the first fan shell 310 passes through the evaporator 520, thus improving a heat dissipation effect of the first box body 600.

It can be understood that the first fan wheel drives the air flow in the first fan shell 310 to pass through the evaporator 520, including but being not limited to the above implementation, and other implementations that enable the air flow in the first fan shell 310 passing through the evaporator 520, and using cold energy in the first fan shell 310 to exchange heat for the first box body 600 all fall within the scope of the present disclosure.

Figure 6:
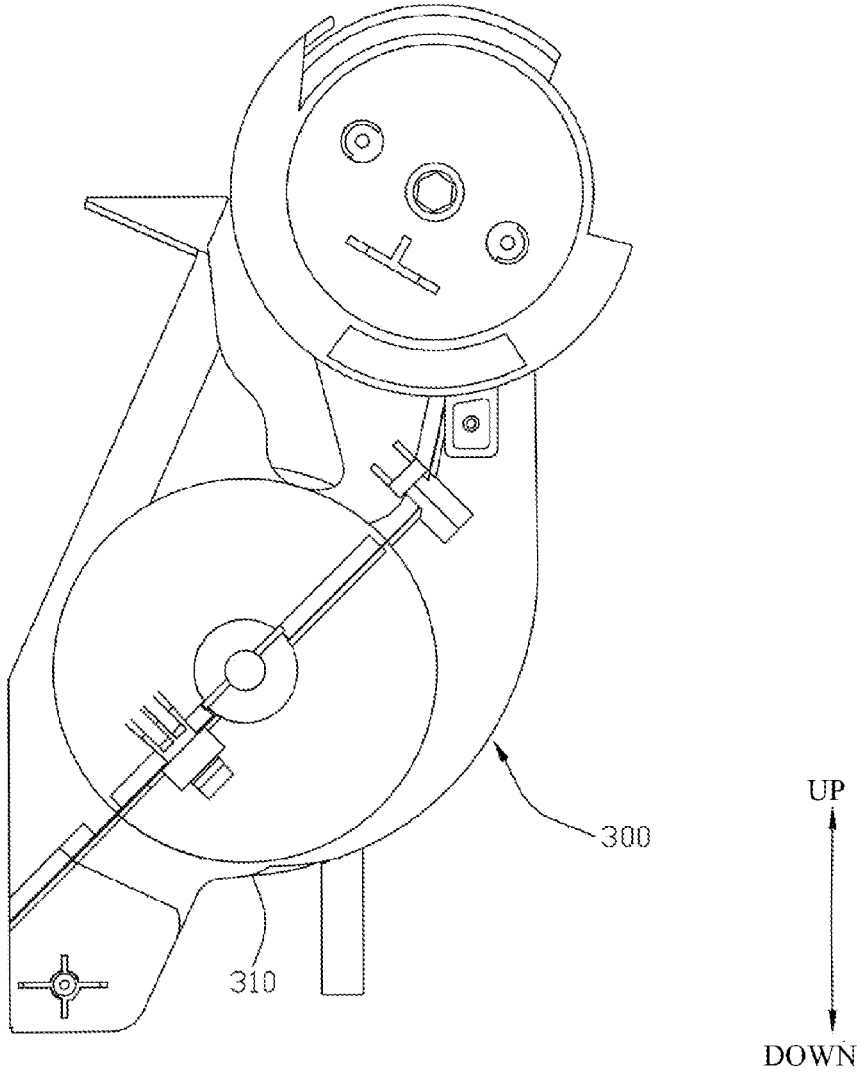
FIG. 6 is a schematic structural diagram of a first fan shell according to an embodiment of the present disclosure.

With reference to FIG. 4 and FIG. 6, a third embodiment of the present disclosure provides an integral air conditioner based on the second embodiment. The first fan wheel is a cross-flow fan wheel.

Compared with a centrifugal fan wheel and an axial-flow fan wheel, the cross-flow fan wheel has a longer rotation shaft, so that the first fan shell 310 has a long length corresponding to the length of the cross-flow fan wheel, thus obtaining a large surface area, and expanding a heat exchange area of the first fan shell 310 above the middle partition plate 200.

In this embodiment, the upper air duct assembly 300 is the first fan. The first fan includes the cross-flow fan wheel and the first fan shell 310. The cross-flow fan wheel is arranged in the first fan shell 310, and drives the air flow in the first fan shell 310 to flow. A first air inlet of the first fan faces the evaporator 520. When the cross-flow fan wheel rotates, a lower-temperature air flow at the first air inlet of the first fan flows into the first fan shell 310 under the driving of the first fan wheel after heat exchange by the evaporator 520. Finally, cold air is blown to a first air outlet of the first fan. When the lower-temperature air flow passes through an inside surface of the first fan shell 310, heat from the air flow on an outside surface of the first fan shell 310 may be rapidly transferred to the first fan shell 310, thus improving a heat dissipation effect of a first box body 600 located between the first fan shell 310 and a middle partition plate 200. Meanwhile, because the first air outlet of the first fan is exposed to users, it is preferred that the noise is not overly loud; the cross-flow fan wheel has an advantage of a small profile, which can improve the user experience.

With reference to FIG. 4, a fourth embodiment of the present disclosure provides an integral air conditioner. The integral air conditioner of this embodiment further includes a lower air duct assembly 400 arranged below a middle partition plate 200.

In this embodiment, an upper air duct assembly 300 and the lower air duct assembly 400 are respectively arranged on upper and lower sides of the middle partition plate 200, so that a mutual influence between the upper air duct and the lower air duct is reduced, and heat exchange between the two air ducts is prevented, thus improving the user experience.

In one implementation, the integral air conditioner includes an outer shell 100. The middle partition plate 200 is arranged in the outer shell 100. The internal space of the outer shell 100 is divided into an upper cavity 210 located above the middle partition plate 200 and a lower cavity 220 located below the middle partition plate 200. The upper air duct assembly 300 is arranged in the upper cavity 210, and the lower air duct assembly 400 is arranged in the lower cavity 220. The upper air duct assembly 300 is a first fan, and the first fan includes a first fan wheel and a first fan shell 310. The first fan wheel is arranged in the first fan shell 310, and drives an air flow in the first fan shell 310 to flow. A first air inlet of the first fan faces the evaporator 520. When the first fan wheel rotates, a lower-temperature air flow at the first air inlet of the first fan flows into the first fan shell 310 under the driving of the first fan wheel after heat exchange by the evaporator 520. Finally, cold air is blown to a first air outlet of the first fan. When the lower-temperature air flow passes through an inside surface of the first fan shell 310, heat from the air flow on an outside surface of the first fan shell 310 may be rapidly transferred to the first fan shell 310, thus improving a heat dissipation effect of a first box body 600 located between the first fan shell 310 and the middle partition plate 200.

A condenser 510 is arranged below the middle partition plate 200, the lower air duct assembly 400 includes a second fan, the second fan includes a second fan wheel and a second fan shell 410, and the second fan wheel is arranged in the second fan shell 410, and drives an air flow in the second fan shell 410 to flow. A second air outlet of the second fan faces the condenser 510. When the second fan wheel rotates, atmosphere near a second air inlet of the second fan is sucked into the second fan shell 410, and blown from the second air outlet of the second fan to the condenser 510, thus accelerating heat exchange of the condenser 510. Because the upper air duct assembly 300 and the lower air duct assembly 400 are separated, the mutual influence between the upper air duct and the lower air duct is reduced, and the heat exchange between the two air ducts is prevented.

In one implementation, the integral air conditioner includes an outer shell 100, the middle partition plate 200 is arranged in the outer shell 100, and an internal space of the outer shell 100 is divided into an upper cavity 210 located above the middle partition plate 200 and a lower cavity 220 located below the middle partition plate 200. The upper air duct assembly 300 is arranged in the upper cavity 210, and the lower air duct assembly 400 is arranged in the lower cavity 220. The upper air duct assembly 300 is the first fan, the first fan includes the cross-flow fan wheel and the first fan shell 310, and the cross-flow fan wheel is arranged in the first fan shell 310, and drives the air flow in the first fan shell 310 to flow. A first air inlet of the first fan faces the evaporator 520. When the cross-flow fan wheel rotates, a lower-temperature air flow at the first air inlet of the first fan flows into the first fan shell 310 under the driving of the cross-flow fan wheel after heat exchange by the evaporator 520. Finally, cold air is blown to a first air outlet of the first fan. When the lower-temperature air flow passes through an inside surface of the first fan shell 310, heat from the air flow on an outside surface of the first fan shell 310 may be rapidly transferred to the first fan shell 310, thus improving a heat dissipation effect of a first box body 600 located between the first fan shell 310 and a middle partition plate 200. Meanwhile, because the first air outlet of the first fan is exposed to users, it is preferred that the noise is not overly loud; the cross-flow fan wheel has an advantage of a small profile, which can improve the user experience.

A condenser 510 is arranged below the middle partition plate 200. The lower air duct assembly 400 includes a second fan, and the second fan includes a second fan wheel and a second fan shell 410. The second fan wheel is arranged in the second fan shell 410, and drives an air flow in the second fan shell 410 to flow. A second air outlet of the second fan faces the condenser 510. When the second fan wheel rotates, air near a second air inlet of the second fan is sucked into the second fan shell 410, and blown from the second air outlet of the second fan to the condenser 510, thus accelerating heat exchange of the condenser 510. Because the upper air duct assembly 300 and the lower air duct assembly 400 are separated, the mutual influence between the upper air duct and the lower air duct is reduced, and the heat exchange between the two air ducts is prevented.

With reference to FIG. 4, a fifth embodiment of the present disclosure provides an integral air conditioner based on the fourth embodiment. The condenser 510 is arranged below the middle partition plate 200, the lower air duct assembly 400 includes a centrifugal fan wheel, and the centrifugal fan wheel is used for driving the air flow to pass through the condenser 510.

In this embodiment, the centrifugal fan wheel is used to exchange heat for the condenser 510. Due to the large air volume of the centrifugal fan wheel, a heat dissipation efficiency of the condenser 510 can be improved.

For example, the integral air conditioner includes the outer shell 100, the middle partition plate 200 is arranged in the outer shell 100, and the internal space of the outer shell 100 is divided into the upper cavity 210 located above the middle partition plate 200 and the lower cavity 220 located below the middle partition plate 200. The upper air duct assembly 300 is arranged in the upper cavity 210, and the lower air duct assembly 400 is arranged in the lower cavity 220. The evaporator 520 is arranged in the upper cavity 210, and the condenser 510 is arranged in the lower cavity 220. The first air outlet of the first fan forming the upper air duct assembly 300 is arranged at a front end of the outer shell 100, and the cross-flow fan wheel is used in the first fan to blow the air flow passing through the evaporator 520 from the first air outlet of the first fan to the user. The cross-flow fan wheel has a good mute effect, thus improving the user experience. The second air outlet of the second fan forming the lower air duct assembly 400 is arranged at a rear end of the outer shell 100 and faces the condenser 510, and the centrifugal fan wheel is used in the second fan to blow air to the condenser 510 through the second air outlet of the second fan. The centrifugal fan wheel has a large air volume, but an unsatisfactory mute effect. Thus, the second air outlet of the second fan is arranged at the rear end of the outer shell 100, facing away from the user, thus further improving the user experience.

Figure 9:
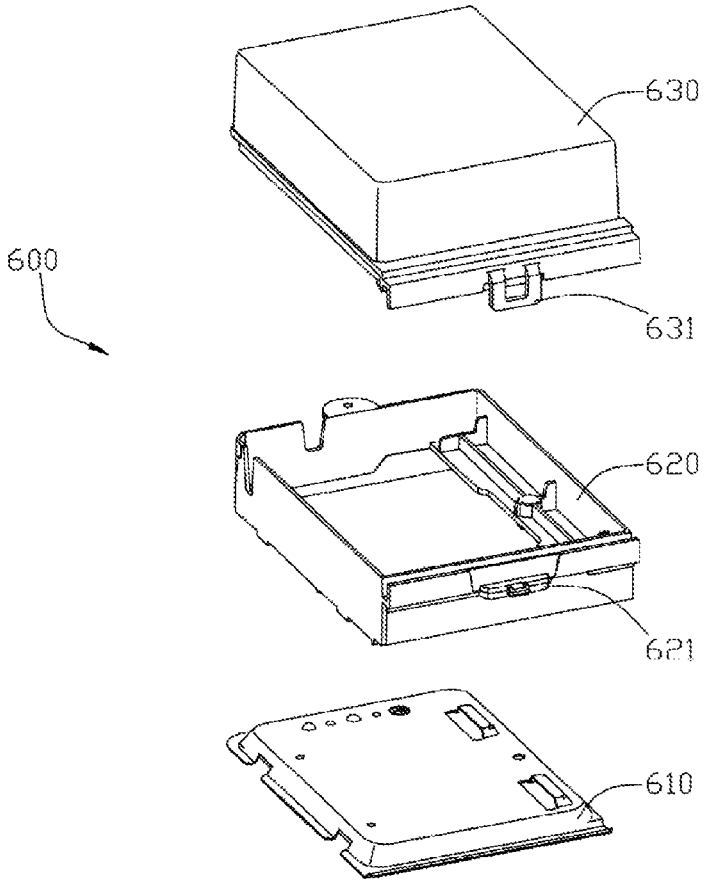
FIG. 9 is a schematic structural diagram of an electric control box in another implementation according to the embodiment of the present disclosure.

With reference to FIG. 6 and FIG. 9, a sixth embodiment of the present disclosure provides an integral air conditioner. The integral air conditioner further includes a first bracket 610 arranged on an upper surface of a middle partition plate 200. A first box body 600 is arranged on the first bracket 610.

In this embodiment, the first box body 600 is mounted above an upper partition plate, and because an evaporator 520 is also arranged above the upper partition plate, a space above the middle partition plate 200 has a low temperature, and it is easy to generate condensation or frost on an upper surface of the middle partition plate 200. The first bracket 610 is used to raise a height of the first box body 600, so that the first box body 600 is prevented from being directly contacted with water on the upper surface of the middle partition plate 200, and a circuit board 650 in the first box body 600 is prevented from being short-circuited, thus improving a safety performance of the integral air conditioner.

As shown in FIG. 9, in one implementation, an inductance part is split from an electric control box and put into the first box body 600, and other parts in the electric control box of the related integral air conditioner are placed in a second box body 700. At the moment, the first bracket 610 is mounted on the upper surface of the middle partition plate 200 by a bolt assembly, a first rear cover 620 is fixed on the first bracket 610 by a bolt assembly, and the circuit board 650 is mounted in the first rear cover 620. A female buckle 621 is arranged on the first rear cover 620, and a male buckle 631 is arranged on a first front cover 630. The first front cover 630 and the first rear cover 620 are connected by a buckle structure composed of the male buckle 631 and the female buckle 621. Thus, the inductance part is covered and protected, which prevents the inductance part from being damaged by external collision.

For example, the first bracket 610 may be locked on the middle partition plate 200 by the bolt assembly. Alternatively, the first bracket 610 is fixed on the middle partition plate 200 by riveting. The upper surface of the middle partition plate 200 may also be provided with a buckle matched with the first bracket 610, and the first bracket 610 is connected to the upper surface of the middle partition plate 200 by the buckle structure.

In one embodiment, a heat dissipation fin 660 is further provided. One end of the heat dissipation fin 660 is connected to the circuit board 650, and the other end of the heat dissipation fin extends out of the first box body 600. For example, the first front cover 630 is provided with a hole, and the other end of the heat dissipation fin 660 protrudes from the hole in the first front cover 630, thus improving a heat dissipation effect of the circuit board 650.

Figure 8:
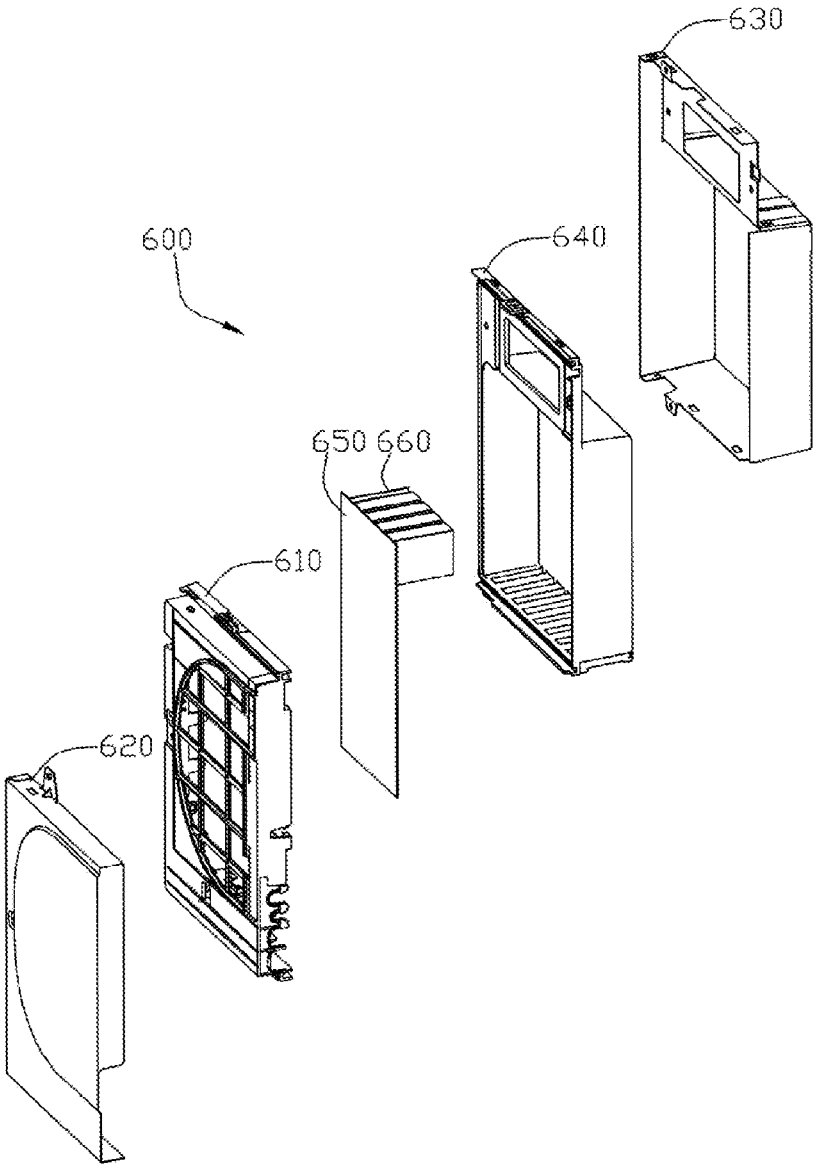
FIG. 8 is a schematic structural diagram of an electric control box in an implementation according to an embodiment of the present disclosure.

With reference to FIG. 8, a seventh embodiment of the present disclosure provides an integral air conditioner. A first box body 600 of the integra air conditioner includes: a circuit board 650 arranged on a first bracket 610; and a first cover body. The first cover body is connected to the first bracket 610 and covered on a periphery of the circuit board 650.

According to Production Compliance, a distance between the circuit board 650 and a plastic shell is determined by a working voltage and an insulation level. In this embodiment, the circuit board 650 is mounted on the first bracket 610 first, and then the first cover body is covered on the periphery of the circuit board 650, which is convenient for adjusting the distance between the first cover body and a surface of the circuit board 650. Moreover, the first cover body achieves an effect of protecting the circuit board 650, thus preventing the circuit board 650 from being damaged by external collision.

In one implementation, the circuit board 650 is welded on the first bracket 610, and the first cover body is fixedly connected to the first bracket 610 by integral injection molding, thus improving a waterproof performance of the first cover body.

In one implementation, the circuit board 650 is fixed on the first bracket 610 by the bolt assembly, and the first cover body includes two sheet metal parts. The two sheet metal parts jointly enclose a periphery of the circuit board 650 and are connected to the first bracket 610 by the bolt assembly, and the two sheet metal parts are locked by the bolt assembly or fixed by the buckle structure.

With reference to FIG. 8, an eight embodiment of the present disclosure provides an integral air conditioner. A first cover body of the integral air conditioner includes a first front cover 630 and a first rear cover 620, and the first front cover 630 is detachably connected with the first rear cover 620.

In this embodiment, for the convenience of assembly, the first cover body is designed in such a way that the first front cover 630 and the first rear cover 620 are detachably connected with each other. When a first box body 600 is assembled, a circuit board 650 is mounted on a first bracket 610 first, then the first front cover 630 and the first rear cover 620 jointly enclose the circuit board 650, and then the first front cover 630 and the first rear cover 620 are fixedly connected. Meanwhile, the first front cover 630 and the first rear cover 620 are connected to the first bracket 610.

In one implementation, an edge of the first front cover 630 is provided with a plurality of through holes, an edge of a second rear cover is provided with a plurality of threaded holes, and bolts through the through holes are connected with the threaded holes in threaded connection to realize a detachable connection between the first front cover 630 and the first rear cover 620. After the first front cover 630 and the first rear cover 620 are locked by the bolts, the first front cover 630 and the first rear cover 620 are fixed on the first bracket 610 by the bolt assembly. The first front cover 630 and the first rear cover 620 are locked by the bolts, which provides a strong connection force between the first front cover 630 and the first rear cover 620, thus improving a firmness of the first cover body.

In another implementation, the detachable connection between the first front cover 630 and the first rear cover 620 is realized by the buckle structure. The edge of the first front cover 630 is provided with a plurality of male buckles 631, and the edge of the first rear cover 620 is provided with a plurality of female buckles 621, so that the first front cover 630 and the first rear cover 620 are locked by buckling the male buckles 631 with the female buckles 621. After the first front cover 630 and the first rear cover 620 are locked by the buckles, the edge of the first front cover 630 and the edge of the first rear cover 620 are fixedly connected to the first bracket 610 by the bolt assembly, and the first cover body is connected to the first bracket 610. The first front cover 630 and the first rear cover 620 are locked by the buckles, such that the first front cover 630 and the first rear cover 620 may be completely assembled without using tools, thus improving an assembly efficiency of the first cover body.

As shown in FIG. 8, in one implementation, in a space enclosed by the first front cover 630 and the first rear cover 620, there is a protective cover in addition to the circuit board 650. One side of the circuit board 650 is connected to the first bracket 610, and the protective cover is arranged on the other side of the circuit board 650, and connected with the bracket by the bolt assembly or the buckles. The protective cover is made of a fireproof plastic material, and used for improving a fireproof performance of an electric control box.

With reference to FIG. 9, a ninth embodiment of the present disclosure provides an integral air conditioner. A first front cover 630 and a first rear cover 620 of the integral air conditioner are detachably connected by a buckle structure.

In this embodiment, the detachable connection between the first front cover 630 and the first rear cover 620 is realized by the buckle structure. An edge of the first front cover 630 is provided with a plurality of male buckles 631, and an edge of the first rear cover 620 is provided with a plurality of female buckles 621, such that the first front cover 630 and the first rear cover 620 are locked by buckling the male buckles 631 with the female buckles 621. After the first front cover 630 and the first rear cover 620 are locked by the buckles, the first front cover 630 and the first rear cover 620 are fixed with the first bracket 610 by the bolt assembly, and the first cover body is connected to the first bracket 610. The first front cover 630 and the first rear cover 620 are locked by the buckles, such that the first front cover 630 and the first rear cover 620 may be completely assembled without using tools, thus improving an assembly efficiency of the first cover body.

A tenth embodiment of the present disclosure provides an integral air conditioner, which further includes a second bracket arranged on a lower surface of a middle partition plate 200. A second box body 700 is arranged on the second bracket.

In this embodiment, the additional second bracket is provided to fix the second box body 700 on the lower surface of the middle partition plate 200, which is convenient for assembling the second box body 700 in the integral air conditioner without changing a structure of the second box body 700.

In one implementation, the second box body 700 includes a circuit board 650 and a second cover body, and the circuit board 650 is arranged on the second bracket. The second cover body is connected to the second bracket and covered on a periphery of the circuit board 650.

According to Production Compliance, a distance between the circuit board 650 and a plastic shell is determined by a working voltage and an insulation level. In this embodiment, the circuit board 650 is mounted on the second bracket first, and then the second cover body is covered on the periphery of the circuit board 650, which is convenient for adjusting the distance between the second cover body and a surface of the circuit board 650. Moreover, the second cover body achieves an effect of protecting the circuit board 650, thus preventing the circuit board 650 from being damaged by external collision.

In one implementation, the circuit board 650 is welded on the second bracket, and the second cover body is fixedly connected to the second bracket by integral injection molding, thus improving a waterproof performance of the second cover body.

In one implementation, the circuit board 650 is fixed on the second bracket by the bolt assembly, and the second cover body includes two sheet metal parts. The two sheet metal parts jointly enclose a periphery of the circuit board 650 and are connected to the second bracket by the bolt assembly, and the two sheet metal parts are locked by the bolt assembly.

An eleventh embodiment of the present disclosure provides an integral air conditioner. A second cover body of the integral air conditioner includes a second front cover and a second rear cover, and the second front cover is detachably connected with the second rear cover.

In this embodiment, for the convenience of assembly, the second cover body is designed in such a way that the second front cover and the second rear cover are detachably connected with each other. When a second box body 700 is assembled, a circuit board 650 is mounted on a second bracket first, then the second front cover and the second rear cover jointly enclose the circuit board 650, and then the second front cover and the second rear cover are fixedly connected. Meanwhile, the second front cover and the second rear cover are connected to the second bracket.

In one implementation, an edge of the second front cover is provided with a plurality of through holes, an edge of the second rear cover is provided with a plurality of threaded holes, and bolts through the through holes are connected with the threaded holes in threaded connection to realize a detachable connection between the second front cover and the second rear cover. After the second front cover and the second rear cover are locked by the bolts, the second front cover and the second rear cover are fixed on the second bracket by the bolt assembly. The second front cover and the second rear cover are locked by the bolts, which provides a strong connection force between the second front cover and the second rear cover, thus improving a firmness of the second cover body.

In another implementation, the detachable connection between the second front cover and the second rear cover is realized by the buckle structure. The edge of the second front cover is provided with a plurality of male buckles 631, and the edge of the second rear cover is provided with a plurality of female buckles 621, so that the second front cover and the second rear cover are locked by buckling the male buckles 631 with the female buckles 621. After the second front cover and the second rear cover are locked by the buckles, the edge of the second front cover and the edge of the second rear cover are fixedly connected to the second bracket by the bolt assembly, and the second cover body is connected to the second bracket. The second front cover and the second rear cover are locked by the buckles, such that the second front cover and the second rear cover may be completely assembled without using tools, thus improving an assembly efficiency of the second cover body.

In one implementation, in a space enclosed by the second front cover and the second rear cover, there is a protective cover in addition to the circuit board 650. One side of the circuit board 650 is connected to the second bracket, and the protective cover is arranged on the other side of the circuit board 650, and connected with the bracket by the bolt assembly or the buckles. The protective cover is made of a fireproof plastic material, and used for improving a fireproof performance of an electric control box.

A twelfth embodiment of the present disclosure provides an integral air conditioner. A second front cover and a second rear cover of the integral air conditioner are detachably connected by a buckle structure.

In this embodiment, the detachable connection between the second front cover and the second rear cover is realized by the buckle structure. The edge of the second front cover is provided with a plurality of male buckles 631, and the edge of the second rear cover is provided with a plurality of female buckles 621, such that the second front cover and the second rear cover are locked by buckling the male buckles 631 with the female buckles 621. After the second front cover and the second rear cover are locked by the buckles, the second front cover and the second rear cover are fixed with the second bracket by the bolt assembly, and the second cover body is connected to the second bracket. The second front cover and the second rear cover are locked by the buckles, such that the second front cover and the second rear cover may be completely assembled without using tools, thus improving an assembly efficiency of the second cover body.

The embodiments of the present disclosure have been described in detail above with reference to the accompanying drawings, but the present disclosure is not limited to the embodiments described above, and various changes may be made without departing from the present disclosure within the scope of knowledge possessed by those of ordinary skill in the art.

The invention claimed is:

1. An integral air conditioner comprising:

a middle partition plate;

an upper air duct assembly arranged above the middle partition plate, wherein the upper air duct assembly comprises a first fan shell and a first fan wheel arranged in the first fan shell, and wherein an idle space is defined between a portion of the middle partition plate and a curved surface of the first fan shell above the portion of the middle partition plate; and an electric control box comprising:

a first box body having a first circuit board arranged therein; and a second box body separate from the first box body, wherein the second box body is arranged below the middle partition plate, and wherein the first box body is arranged in the idle space between the portion of the middle partition plate and the curved surface of the first fan shell above the portion of the middle partition plate.

2. The integral air conditioner according to claim 1, further comprising an evaporator arranged above the middle partition plate, wherein the first fan wheel is configured to drive air flow in the first fan shell to pass through the evaporator.

3. The integral air conditioner according to claim 2, wherein the first fan wheel comprises a cross-flow fan wheel.

4. The integral air conditioner according to claim 1, further comprising a lower air duct assembly arranged below the middle partition plate.

5. The integral air conditioner according to claim 2, further comprising a lower air duct assembly arranged below the middle partition plate.

6. The integral air conditioner according to claim 3, further comprising a lower air duct assembly arranged below the middle partition plate.

7. The integral air conditioner according to claim 4, further comprising a condenser arranged below the middle partition plate, wherein the lower air duct assembly comprises a centrifugal fan wheel configured to drive an air flow to pass through the condenser.

8. The integral air conditioner according to claim 1, further comprising:

an upper bracket arranged on an upper surface of the middle partition plate, wherein the first box body is arranged on the upper bracket.

9. The integral air conditioner according to claim 8, wherein the first circuit board is arranged on upper bracket; and wherein the first box body further comprises a first cover body, wherein the first cover body is connected to the upper bracket and covers a periphery of the first circuit board.

10. The integral air conditioner according to claim 9, wherein the first cover body comprises a first front cover and a first rear cover, and the first front cover is detachably connected with the first rear cover.

11. The integral air conditioner according to claim 10, wherein the first front cover and the first rear cover are detachably connected by a buckle structure.

12. The integral air conditioner according to claim 1, further comprising a a lower bracket arranged on a lower surface of the middle partition plate, wherein the second box body is arranged on the lower bracket.

* * * * *